US011365923B2

(12) United States Patent
Ishiyama

(10) Patent No.: US 11,365,923 B2
(45) Date of Patent: Jun. 21, 2022

(54) REFRIGERATION CYCLE APPARATUS

(71) Applicant: Mitsubishi Electric Corporation, Tokyo (JP)

(72) Inventor: Hiroki Ishiyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 39 days.

(21) Appl. No.: 16/767,210

(22) PCT Filed: Dec. 6, 2017

(86) PCT No.: PCT/JP2017/043754
§ 371 (c)(1),
(2) Date: May 27, 2020

(87) PCT Pub. No.: WO2019/111342
PCT Pub. Date: Jun. 13, 2019

(65) Prior Publication Data

US 2021/0010725 A1 Jan. 14, 2021

(51) Int. Cl.
*F25B 31/00* (2006.01)
*F25B 41/20* (2021.01)
(Continued)

(52) U.S. Cl.
CPC ..... *F25B 49/02* (2013.01); *F25B 31/002* (2013.01); *F25B 43/02* (2013.01); *F25B 2600/2515* (2013.01); *F25B 2700/03* (2013.01)

(58) Field of Classification Search
CPC ..... F25B 31/002; F25B 41/20; F25B 43/02; F25B 49/02; F25B 2600/2515;
(Continued)

(56) References Cited

U.S. PATENT DOCUMENTS 6,672,102 B1 * 1/2004 Huenniger ..... F25B 1/047 62/472
6,705,094 B2 * 3/2004 Alsenz ..... F25B 1/00 62/116
(Continued)

FOREIGN PATENT DOCUMENTS

EP 3 034 964 A1 6/2016
JP H05-312418 A 11/1993
(Continued)

OTHER PUBLICATIONS

Extended European Search Report dated Oct. 30, 2020 issued in corresponding EP patent application No. 17934244.9.
(Continued)

*Primary Examiner* — Miguel A Diaz
(74) *Attorney, Agent, or Firm* — Posz Law Group, PLC

(57) ABSTRACT

A refrigeration cycle apparatus includes: a refrigerant circuit; an oil reservoir; a first pipe that connects the oil separator and the oil reservoir, the first pipe being configured to send the refrigeration oil separated by the oil separator to the oil reservoir; a first valve provided at the first pipe; a second pipe that connects the oil reservoir and a suction side of the compressor; a second valve provided at the second pipe; a third pipe that connects the oil reservoir and the suction side of the compressor at a position lower than a position at which the second pipe is connected to the oil reservoir; and a third valve provided at the third pipe. The first to third valves are closed in a non-operational period of the compressor.

1 Claim, 9 Drawing Sheets

(51) Int. Cl.
*F25B 43/02* (2006.01)
*F25B 49/02* (2006.01)

(58) Field of Classification Search
CPC ..... F25B 2700/03; F25B 2700/1932; F25B 2700/2105; F25B 2700/21155; F25B 2500/16
See application file for complete search history.

(56) References Cited

U.S. PATENT DOCUMENTS

| | | | | |
|---|---|---|---|---|
| 8,463,441 | B2 * | 6/2013 | Zugibe | F25B 43/02 700/275 |
| 9,163,622 | B2 * | 10/2015 | Sata | F04B 39/023 |
| 9,360,011 | B2 * | 6/2016 | Perevozchikov | F25B 49/02 |
| 9,970,695 | B2 * | 5/2018 | Hellmann | F25B 41/00 |
| 10,267,548 | B2 * | 4/2019 | Esformes | F25B 43/02 |
| 10,724,773 | B2 * | 7/2020 | Suemitsu | F04D 27/007 |
| 2008/0173425 | A1 * | 7/2008 | Wiggs | F25B 30/06 165/45 |
| 2008/0210601 | A1 * | 9/2008 | Shoulders | F25B 43/02 208/184 |
| 2020/0300514 | A1 * | 9/2020 | Ishiyama | F25B 31/004 |

FOREIGN PATENT DOCUMENTS

| | | | | |
|---|---|---|---|---|
| JP | 2008-139001 | A | 6/2008 | |
| JP | 2015-038406 | A | 2/2015 | |
| JP | 2016-118317 | A | 6/2016 | |
| WO | WO-2013099047 | A1 * | 7/2013 | F25B 31/004 |
| WO | 2015/025515 | A1 | 2/2015 | |
| WO | 2016/121184 | A1 | 8/2016 | |
| WO | WO-2016121184 | A1 * | 8/2016 | F25B 31/004 |

OTHER PUBLICATIONS

International Search Report of the International Searching Authority dated Feb. 27, 2018 for the corresponding international application No. PCT/JP2017/043754 (and English translation).

Office Action dated May 31, 2021 issued in corresponding CN patent application No. 201780097348.9 (and English machine translation).

Japanese Office Action dated Feb. 16, 2021, issued in corresponding JP Patent Application No. 2019-557914 (and English Machine Translation).

Office Action dated Feb. 2, 2022 issued in corresponding EP patent application No. 17934244.9.

* cited by examiner

REFRIGERATION CYCLE APPARATUS

CROSS REFERENCE TO RELATED APPLICATION

This application is a U.S. national stage application of International Application PCT/JP2017/043754 filed on Dec. 6, 2017, the contents of which are incorporated herein by reference.

TECHNICAL FIELD

The present invention relates to a refrigeration cycle apparatus, in particular, a refrigeration cycle apparatus including an oil separator configured to separate refrigeration oil from refrigerant gas supplied from a compressor.

BACKGROUND

Oil separators are provided in some types of refrigeration cycle apparatuses in order to avoid an operation that may cause exhaustion of refrigeration oil in compressors. Each of the oil separators is configured to separate the refrigeration oil from refrigerant gas discharged from the compressor. However, when a large amount of oil is returned to the compressor during a normal operation, an excess of oil is provided in the compressor, thus resulting in decreased performance, disadvantageously. To address this, a refrigeration cycle apparatus disclosed in Japanese Patent Laying-Open No. 2008-139001 (Patent Literature 1) is provided with an oil reservoir container so as to store surplus oil in the oil reservoir container during a normal operation and cause the surplus oil stored therein to flow to a compressor during an oil exhaustion operation.

This refrigeration cycle apparatus includes a refrigerant circuit for performing a vapor-compression refrigeration cycle, the refrigerant circuit including: an oil separator connected to a discharge side of the compressor; the oil reservoir container that communicates with the oil separator, the oil reservoir container being configured to store refrigeration oil separated by the oil separator; and a connection pipe connected to the oil reservoir container and a suction side of the compressor, the connection pipe having an opening/closing valve to return the refrigeration oil in the oil reservoir container to the suction side of the compressor.

The oil reservoir container constitutes a sealed container and is connected to the oil separator by an oil inflow pipe. The oil reservoir container is disposed below the oil separator. The oil reservoir container is configured to allow the refrigeration oil separated by the oil separator to flow thereinto via the oil inflow pipe due to its weight. That is, the surplus oil collecting mechanism is configured to collect, into the oil reservoir container, a whole of the refrigeration oil flowing from the compressor and separated by the oil separator.

PATENT LITERATURE

PTL 1: Japanese Patent Laying-Open No. 2008-139001 (claim 1 and paragraph 0044)

When the oil reservoir container is provided, refrigerant is dissolved in the oil while external air has a low temperature, thus resulting in a low oil concentration. This leads to oil exhaustion in the compressor. Such a phenomenon is noticeable particularly while the compressor is non-operational. Even with the oil reservoir, oil exhaustion cannot be prevented completely.

In the refrigeration cycle apparatus disclosed in Japanese Patent Laying-Open No. 2008-139001, the refrigerant cannot be suppressed from being dissolved in the refrigeration oil in the oil separator and the oil reservoir container while it is non-operational, with the result that an oil concentration of liquid in the oil reservoir container is decreased, disadvantageously. Moreover, when starting the operation of the compressor, mixed liquid discharged from the compressor while it is operational and having a low oil concentration flows into the oil reservoir container, with the result that the oil concentration of the liquid in the oil reservoir container is decreased, disadvantageously. When the mixed liquid having a low oil concentration flows from the oil reservoir into the compressor, oil becomes exhausted in the compressor. This may result in decreased reliability of the compressor.

Moreover, when the refrigeration oil is stored in the oil reservoir container, the refrigerant is dissolved in the refrigeration oil, with the result that an amount of refrigerant in the refrigerant circuit is decreased. Accordingly, the amount of refrigerant in the refrigerant circuit becomes less than or equal to an appropriate amount of refrigerant, thus resulting in decreased performance of the refrigerating cycle. To maintain the amount of refrigerant at the appropriate amount of refrigerant in the refrigerant circuit, an amount of refrigerant sealed in the refrigerant circuit is increased, disadvantageously.

Moreover, when the refrigerant is dissolved in the refrigeration oil within the oil reservoir container, a volume thereof is increased, with the result that overflow may be caused in the oil reservoir container. When overflow is caused in the oil reservoir container, an oil separation ratio is decreased in the oil separator, with the result that performance of the refrigerating cycle and reliability of the compressor are decreased.

SUMMARY

The present invention has been made to solve the foregoing problems, and has an object to provide a refrigeration cycle apparatus that can maintain a concentration of refrigeration oil in an oil reservoir container and that can prevent oil exhaustion in a compressor.

The present disclosure relates to a refrigeration cycle apparatus. The refrigeration cycle apparatus includes: a refrigerant circuit in which refrigerant circulates in the order of a compressor, an oil separator, a first heat exchanger, a decompressing apparatus, and a second heat exchanger and returns to the compressor; an oil reservoir configured to store refrigeration oil; a first pipe that connects the oil separator and the oil reservoir, the first pipe being configured to send the refrigeration oil separated by the oil separator to the oil reservoir; a first valve provided at the first pipe; a second pipe that connects the oil reservoir and a suction side of the compressor; a second valve provided at the second pipe; a third pipe that connects the oil reservoir and the suction side of the compressor at a position lower than a position at which the second pipe is connected to the oil reservoir; and a third valve provided at the third pipe. The first to third valves are closed in a non-operational period of the compressor.

According to the present invention, since decrease in the oil concentration of the liquid stored in the oil reservoir can be prevented during the non-operational period by closing the valves provided at the inlet/outlet pipes for the oil reservoir configured to store the refrigeration oil separated by the oil separator, occurrence of oil exhaustion in the compressor can be prevented.

DETAILED DESCRIPTION

Figure 1:
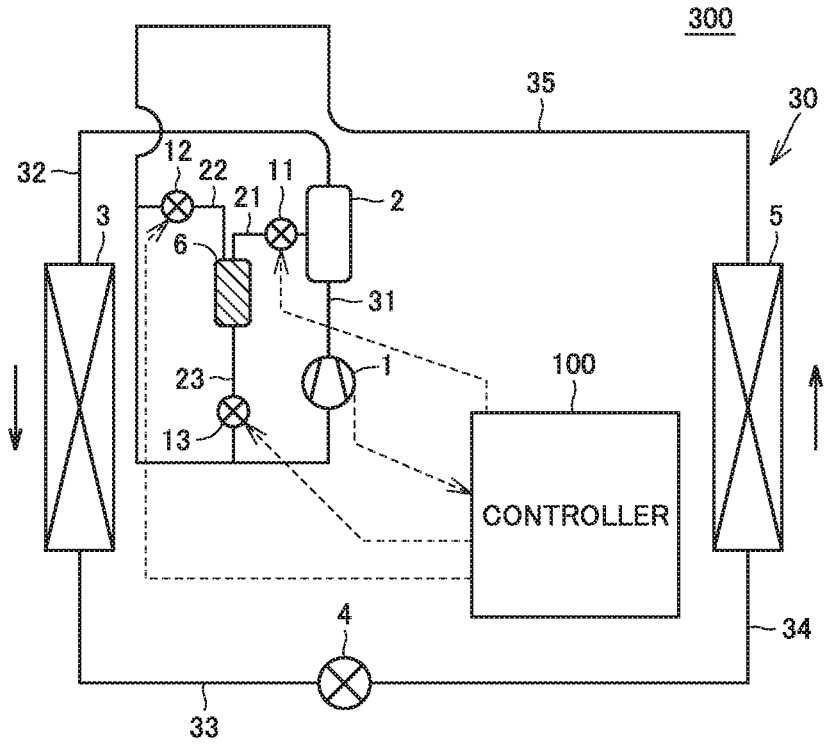
FIG. 1 shows a configuration of a refrigeration cycle apparatus according to a first embodiment.

The following describes embodiments of the present invention in detail with reference to figures. It should be noted that in the figures described below, a relation in sizes among respective component members may differ from an actual relation. Moreover, in the figures below, the same reference characters are given to the same or corresponding components. This applies to the entire content of the specification.

Furthermore, embodiments of components described in the entire content of the specification are just exemplary, rather than limitation.

First Embodiment (Configuration of Refrigeration Cycle Apparatus)

FIG. 1 shows a configuration of a refrigeration cycle apparatus according to a first embodiment. A refrigeration cycle apparatus 300 shown in FIG. 1 includes a refrigerant circuit 30 in which refrigerant circulates in the order of a compressor 1, an oil separator 2, a first heat exchanger 3 (high-pressure side), a decompressing apparatus 4, and a second heat exchanger 5 (low-pressure side) and returns to compressor 1. The elements of refrigerant circuit 30 are connected to one another by pipes 31 to 35.

Refrigeration cycle apparatus 300 further includes: an oil reservoir 6 configured to store refrigeration oil; a first pipe 21; a second pipe 22; and a third pipe 23.

First pipe 21 connects oil separator 2 and oil reservoir 6, and is configured to send the refrigeration oil separated by oil separator 2 to oil reservoir 6. Second pipe 22 connects oil reservoir 6 and low-pressure pipe 35 at the suction side of compressor 1. At a position lower than the position at which second pipe 22 is connected to oil reservoir 6, third pipe 23 connects oil reservoir 6 and low-pressure pipe 35 at the suction side of compressor 1.

Refrigeration cycle apparatus 300 further includes: a first valve 11 provided at first pipe 21; a second valve 12 provided at second pipe 22; a third valve 13 provided at third pipe 23; and a controller 100.

Third valve 13 is an oil returning amount regulating valve provided at third pipe 23. The oil returning amount regulating valve is a valve configured to adjust an amount of returning oil to be sent from oil reservoir 6 to compressor 1.

Mixed liquid flows from oil separator 2 into oil reservoir 6 via first pipe 21 serving as an oil returning pipe and a first valve 11 serving as an oil storage amount regulating valve. The refrigeration oil is returned from oil reservoir 6 to compressor 1 via third pipe 23 serving as an oil returning pipe and a third valve 13 serving as an oil returning amount regulating valve. Moreover, the refrigerant gas is returned from oil reservoir 6 to compressor 1 via second pipe 22 serving as a gas removing pipe and a second valve 12 serving as a shutoff valve.

As described above, all the pipes connected to oil reservoir 6 are provided with the respective closable valves. Hence, refrigeration cycle apparatus 300 is configured to hermetically seal oil reservoir 6. In the non-operational period of compressor 1, first to third valves 11 to 13 are all closed, whereby refrigerant outside oil reservoir 6 is prevented from being dissolved in the refrigeration oil in oil reservoir 6.

Figure 2:
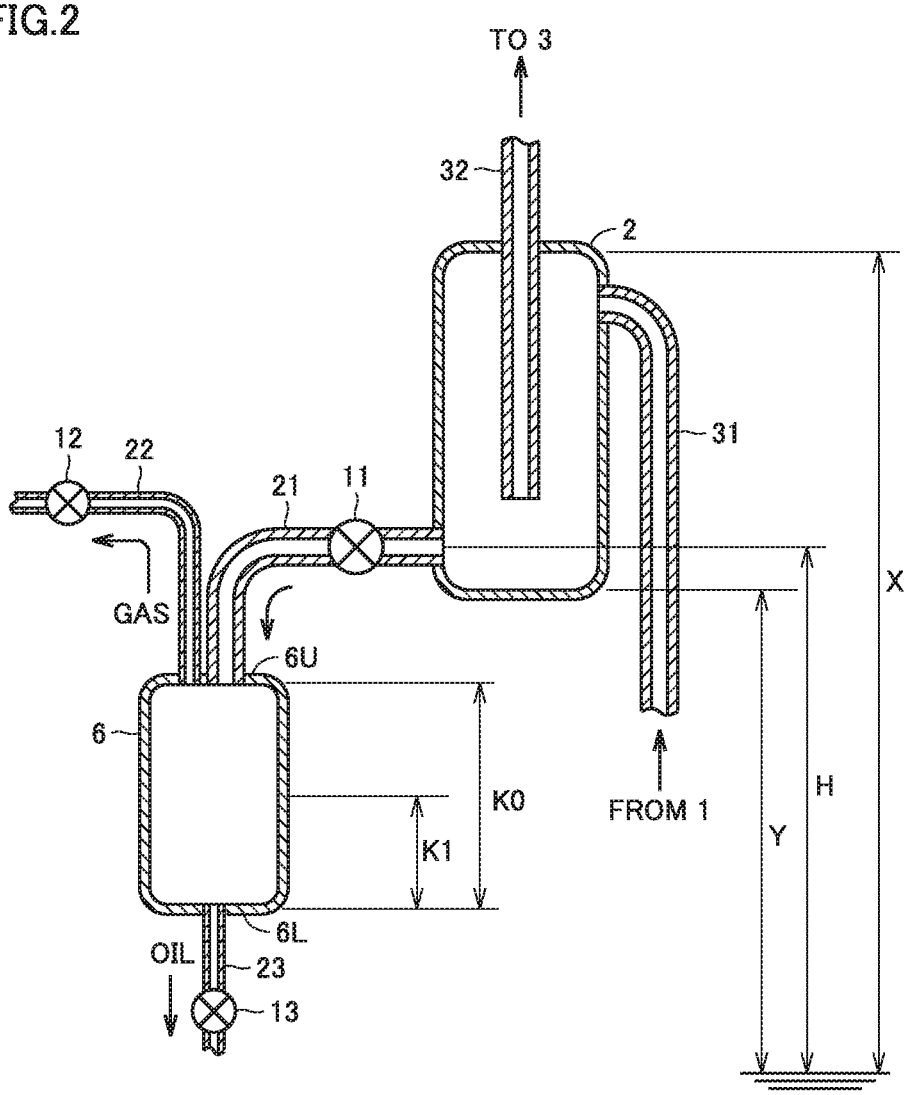
FIG. 2 is a partial enlarged view showing a connection between an oil separator 2 and an oil reservoir 6 in detail.

FIG. 2 is a partial enlarged view showing a connection between oil separator 2 and oil reservoir 6 in detail. With reference to FIG. 1 and FIG. 2, oil separator 2 is connected between compressor 1 and first heat exchanger 3 at the high-pressure side by pipes 31, 32. An upper base surface 6U of oil reservoir 6 is connected to oil separator 2 by first pipe 21. Also, upper base surface 6U of oil reservoir 6 is connected, by second pipe 22, to low-pressure pipe 35 between compressor 1 and second heat exchanger 5 at the low-pressure side. A lower base surface 6L of oil reservoir 6 is connected, by third pipe 23 serving as an oil removing pipe, to low-pressure pipe 35 between compressor 1 and second heat exchanger 5 at the low-pressure side.

Oil reservoir 6 is installed below oil separator 2. Accordingly, the liquid in oil separator 2 flows into oil reservoir 6 via first pipe 21 due to gravity.

One end of first pipe 21 is connected to upper base surface 6U of oil reservoir 6. The other end of first pipe 21 is connected to a position at a height H from a ground. Height H satisfies $Y \leq H \leq Y+(X-Y)/2$. X represents a distance between the ground (a bottom surface of an outdoor unit) and an upper end of oil separator 2. Y represents a distance between the ground (the bottom surface of the outdoor unit) and a lower end of oil separator 2.

Second pipe 22 connects upper base surface 6U of oil reservoir 6 and low-pressure pipe 35 at the suction side of compressor 1. Third pipe 23 connects lower base surface 6L of oil reservoir 6 and low-pressure pipe 35 at the suction side of compressor 1.

Definitions of Terms

Before explaining operations of refrigeration cycle apparatus 300, the following describes some terms used in the present specification.

The term "mixed liquid" refers to liquid in a state in which refrigerant is dissolved in refrigeration oil.

The term "surplus oil" refers to a surplus of refrigeration oil with respect to an appropriate amount of oil in compressor 1. Regarding the refrigeration oil sealed in the refrigeration cycle apparatus, an amount of oil (appropriate amount of oil) required by compressor 1 is changed depending on an operation state. Particularly, an appropriate amount of oil in a stable state is smaller than an appropriate amount of oil in a transition state (an operation in which a change of an actuator occurs transitionally such as starting or defrosting operation). Hence, when refrigeration oil is sealed therein in consideration of the transition state, a surplus of refrigeration oil exists in the stable state with respect to the appropriate amount of oil. This surplus of refrigeration oil is regarded as "surplus oil".

The term "overflow" refers to a phenomenon in which the mixed liquid is flooded from oil reservoir 6 to raise a liquid level in oil separator 2 when a flow rate of the mixed liquid flowing from pipe 21 into oil reservoir 6 is more than a flow rate of the mixed liquid flowing out to pipe 23. The overflow leads to extreme decrease of efficiency of separation between the oil and the refrigerant in oil separator 2.

The term "oil collection operation" refers to an operation for storing the refrigeration oil into oil reservoir 6 in a case where no oil exhaustion is concerned, such as a case where there is a sufficient amount of refrigeration oil in compressor 1.

The "oil returning operation" refers to an operation for returning the oil stored in oil reservoir 6 to compressor 1 in a case where oil exhaustion is concerned, such as a case where the operation frequency of compressor 1 is changed rapidly upon the starting, the defrosting operation, or the like.

(Explanation for Operation of Refrigeration Cycle Apparatus)

In a normal operation mode, controller 100 controls a degree of opening of the oil returning amount regulating valve (valve 13) to attain a small degree of opening or a fully closed state, controls a degree of opening of the oil storage amount regulating valve (valve 11) to attain a large degree of opening or a fully opened state, and controls the shutoff valve (valve 12) to attain a fully opened state.

Figure 3:
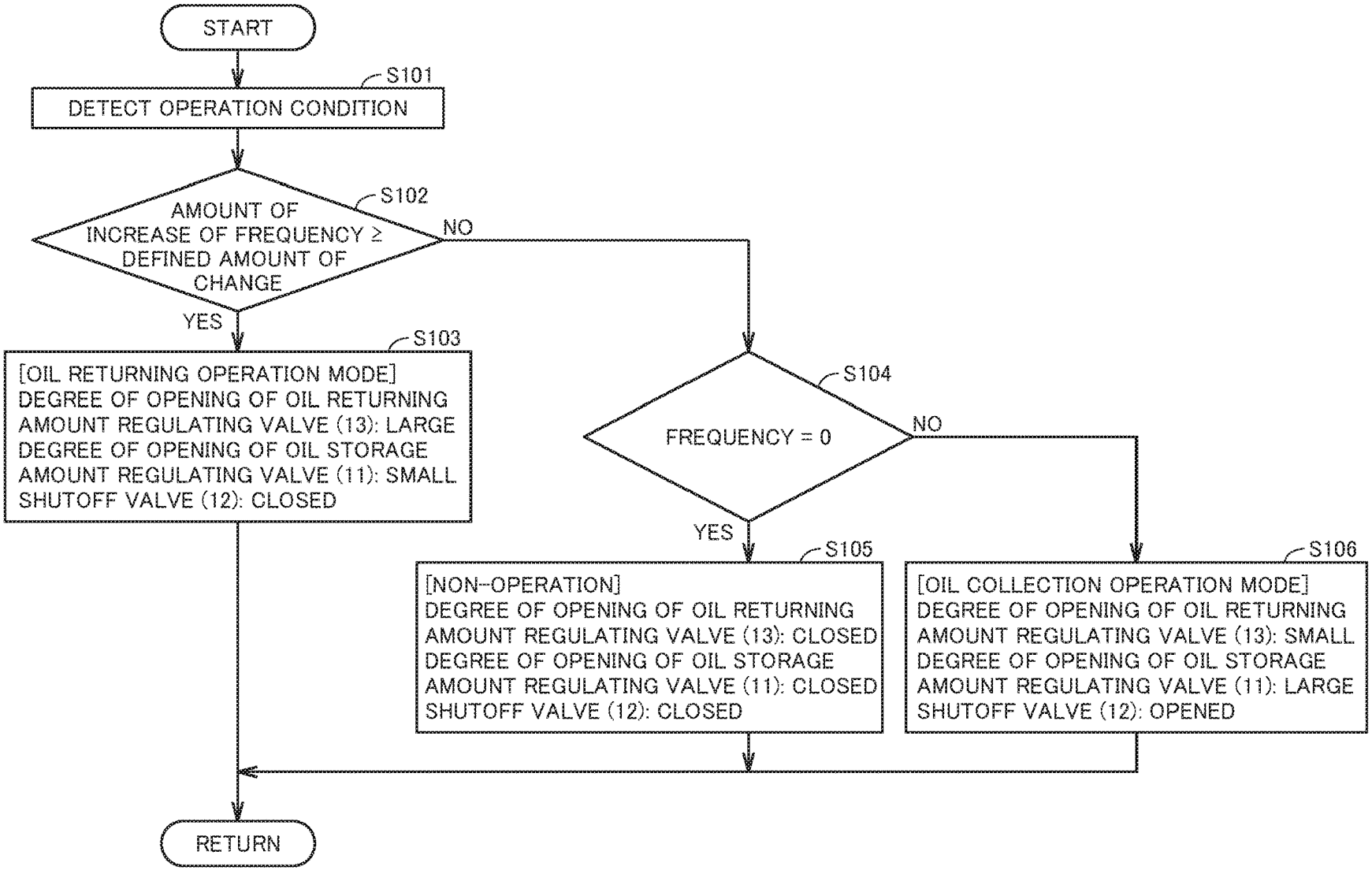
FIG. 3 is a flowchart for illustrating control performed by a controller 100 for valves.

FIG. 3 is a flowchart for illustrating control performed by controller 100 for valves. A process of this flowchart is invoked from a main routine for performing general control for refrigeration cycle apparatus 300 and is executed, whenever a certain period of time elapses or a starting condition is satisfied.

With reference to FIG. 1 and FIG. 3, when an operation is started, controller 100 detects an operation condition of refrigeration cycle apparatus 300 in a step S101. This operation condition also includes an operation frequency of compressor 1.

Then, in a step S102, controller 100 compares an amount of increase of the operation frequency of compressor 1 with a defined amount of change. When the operation frequency of compressor 1 is increased by more than or equal to the defined amount of change (YES in S102), a large amount of refrigeration oil is required in compressor 1. Hence, in a step S103, controller 100 sets the operation mode to an oil returning operation mode.

In the oil returning operation mode, controller 100 controls the degree of opening of the oil returning amount regulating valve (valve 13) to attain a large degree of opening or a fully opened state, controls the degree of opening of the oil storage amount regulating valve (valve 11) to attain a small degree of opening or a fully closed state, and controls the shutoff valve (valve 12) to attain a fully closed state.

In the oil returning operation mode, gas refrigerant and mixed liquid discharged from compressor 1 of FIG. 1 flow into oil separator 2. The gas refrigerant and the mixed liquid are separated from each other in oil separator 2, the gas refrigerant flows into first heat exchanger 3 at the high-pressure side, and the mixed liquid flows into oil reservoir 6. The mixed liquid having flown into oil reservoir 6 flows from oil reservoir 6, passes through third pipe 23 serving as an oil removing pipe and the oil returning amount regulating valve (valve 13), passes through low-pressure pipe 35 between compressor 1 and second heat exchanger 5 at the low-pressure side, and is then supplied to compressor 1.

On the other hand, when the amount of increase of the operation frequency of compressor 1 is less than the defined amount of change (NO in S102), controller 100 detects the frequency of compressor 1 in a step S104. Here, when the frequency is not zero and the amount of increase of the operation frequency of compressor 1 is less than the defined amount of change (NO in S104), the amount of required refrigeration oil in compressor 1 is a normal amount thereof. Hence, in a step S106, controller 100 sets the operation mode to the oil collection operation mode to decrease the degree of opening of the oil returning amount regulating valve (valve 13).

In the oil collection operation mode, controller 100 controls the degree of opening of the oil returning amount regulating valve (valve 13) to attain a small degree of opening or a fully closed state, controls the degree of opening of the oil storage amount regulating valve (valve 11) to attain a large degree of opening or a fully opened state, and controls the shutoff valve (valve 12) to attain a fully opened state.

In the oil collection operation mode, the gas refrigerant and mixed liquid discharged from compressor 1 of FIG. 1 flow into oil separator 2. The gas refrigerant and the mixed liquid are separated from each other in oil separator 2, the gas refrigerant flows out to first heat exchanger 3 at the high-pressure side, and the mixed liquid flows into oil reservoir 6 through the oil storage amount regulating valve (valve 11). The gas refrigerant in oil reservoir 6 flows into low-pressure pipe 35 through second pipe 22 serving as a gas removing pipe and the shutoff valve (valve 12). The mixed liquid raises a liquid level in oil reservoir 6. When the liquid level is raised to reach a connection portion of second pipe 22 installed at an upper portion in oil reservoir 6, the mixed liquid flows into compressor 1 via second pipe 22 and low-pressure pipe 35.

On the other hand, when the operation frequency of compressor 1 is zero (YES in S104), during a non-operational period of refrigeration cycle apparatus 300 (compressor 1), controller 100 controls to fully close the oil returning amount regulating valve (valve 13), the oil storage amount regulating valve (valve 11), and the shutoff valve (valve 12) in step S105. By closing the valves while compressor 1 is non-operational, a flow path between oil reservoir 6 and refrigerant circuit 30 is shut off, whereby the refrigerant in refrigerant circuit 30 is not moved to oil reservoir 6. In this way, even when the temperature of the mixed liquid in oil reservoir 6 is decreased during the non-operational period of compressor 1, the refrigerant is prevented from being moved from refrigerant circuit 30 and being dissolved in the mixed liquid.

Accordingly, the oil concentration of the mixed liquid is prevented from being decreased. It should be noted that timings to close the three valves may not be simultaneous as long as the non-operational period of compressor 1 includes a period during which the oil returning amount regulating valve (valve 13), the oil storage amount regulating valve (valve 11), and the shutoff valve (valve 12) are all closed.

When the degree of opening of the oil returning amount regulating valve (valve 13) is determined in one of steps S103, S105, and S106, the control is returned to the main routine.

As described above, according to the refrigeration cycle apparatus of the first embodiment, the following effects are obtained.

By storing the surplus oil in oil reservoir 6 in the oil collection operation mode, performance of compressor 1 can be improved. By collecting the oil while removing gas via the gas removing pipe during the oil collection operation mode, an oil collection time can be shortened.

In the oil returning operation mode, the mixed liquid having a low oil concentration and discharged from compressor 1 is suppressed from being moved to oil reservoir 6, thereby suppressing decrease of the oil concentration in oil reservoir 6. Accordingly, reliability of the compressor can be improved.

By shutting off oil reservoir 6 and refrigerant circuit 30 during the non-operational period of the compressor, the refrigerant is prevented from being moved to oil reservoir 6. Since the refrigerant is not moved into oil reservoir 6 during the non-operational period, the oil concentration is suppressed from being decreased by the refrigerant in refrigerant circuit 30, whereby the mixed liquid having a high oil concentration can flow into compressor 1. Accordingly, reliability of compressor 1 can be improved.

Second Embodiment

In a second embodiment, a liquid level sensor configured to detect a liquid level height of the mixed liquid stored in oil reservoir 6 is installed in the configuration of the first embodiment so as to control a valve to allow the liquid level height to coincide with a defined position.

Figure 4:
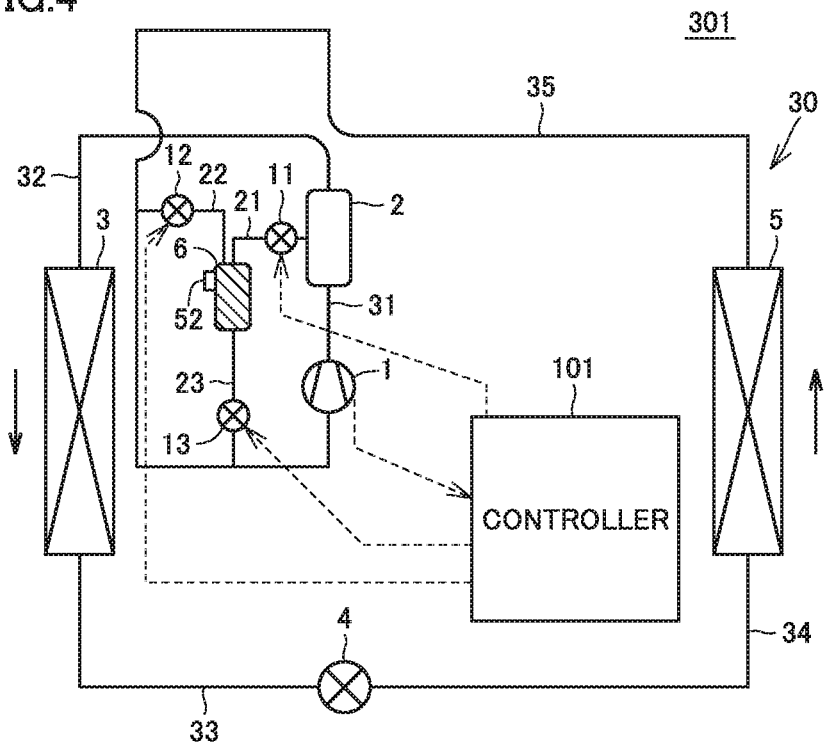
FIG. 4 shows a configuration of a refrigeration cycle apparatus according to a second embodiment.

FIG. 4 shows a configuration of a refrigeration cycle apparatus according to the second embodiment. A refrigeration cycle apparatus 301 shown in FIG. 4 includes: a refrigerant circuit 30 in which refrigerant circulates in the order of a compressor 1, an oil separator 2, a first heat exchanger 3, a decompressing apparatus 4, and a second heat exchanger 5 and returns to compressor 1; an oil reservoir 6; pipes 21 to 23; and valves 11 to 13. These are the same as those of refrigeration cycle apparatus 300 of the first embodiment, and will not be repeatedly described.

Refrigeration cycle apparatus 300 further includes: a liquid level sensor 52 configured to detect a liquid level height of liquid stored in oil reservoir 6; and a controller 101 configured to control valves 11 to 13 in accordance with the liquid level height detected by liquid level sensor 52. Controller 101 controls valves 11 to 13 to allow the liquid level height to coincide with a defined position. As liquid level sensor 52, it is possible to use: a sensor configured to detect a change in electric resistance; a sensor configured to detect a change in capacitance; a sensor configured to detect reflection of ultrasonic wave, electric wave, or laser light; or the like.

Figure 5:
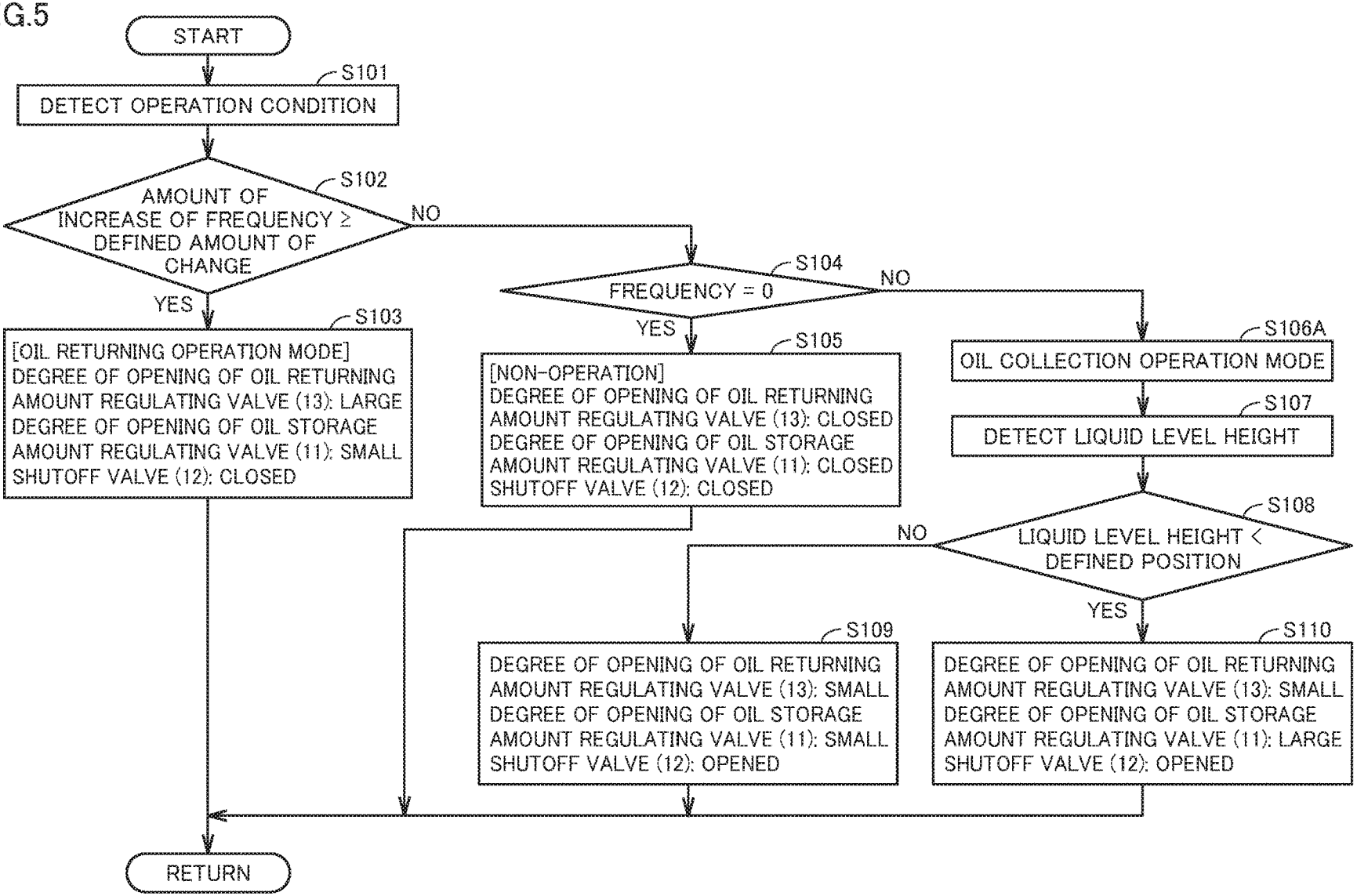
FIG. 5 is a flowchart for illustrating control performed by a controller 101 for valves.

FIG. 5 is a flowchart for illustrating control performed by controller 101 for the valves. A process of this flowchart is invoked from a main routine for performing general control for refrigeration cycle apparatus 301 and is executed, whenever a certain period of time elapses or a starting condition is satisfied.

With reference to FIG. 4 and FIG. 5, controller 101 first detects an operation condition of refrigeration cycle apparatus 300 in a step S101. This operation condition also includes an operation frequency of compressor 1.

Then, in a step S102, controller 101 compares an amount of increase of the operation frequency of compressor 1 with a defined amount of change. When the operation frequency of compressor 1 is increased by more than or equal to the defined amount of change (YES in S102), a large amount of refrigeration oil is required in compressor 1. Hence, in a step S103, controller 101 sets the operation mode to an oil returning operation mode.

In the oil returning operation mode, controller 101 controls the degree of opening of the oil returning amount regulating valve (valve 13) to attain a large degree of opening or a fully opened state, controls the degree of opening of the oil storage amount regulating valve (valve 11) to attain a small degree of opening or a fully closed state, and controls the shutoff valve (valve 12) to attain a fully closed state.

On the other hand, when the amount of increase of the operation frequency of compressor 1 is less than the defined amount of change (NO in S102), controller 101 detects the frequency of compressor 1 in a step S104.

When the operation frequency of compressor 1 is zero (YES in S104), during a non-operational period of refrigeration cycle apparatus 300 (compressor 1), controller 101 controls to fully close the oil returning amount regulating valve (valve 13), the oil storage amount regulating valve (valve 11), and the shutoff valve (valve 12) in a step S105. By closing the valves while compressor 1 is non-operational, a flow path between oil reservoir 6 and refrigerant circuit 30 is shut off, whereby the refrigerant in refrigerant circuit 30 is not moved to oil reservoir 6. In this way, even when the temperature of the mixed liquid in oil reservoir 6 is decreased during the non-operational period of compressor 1, the refrigerant is prevented from being moved from refrigerant circuit 30 and being dissolved in the mixed liquid. Accordingly, the oil concentration of the mixed liquid is prevented from being decreased.

On the other hand, when the frequency is not zero and the amount of increase of the operation frequency of compressor 1 is less than the defined amount of change (NO in S104), the amount of required refrigeration oil in compressor 1 is a normal amount thereof. Hence, in a step S106A, controller 101 sets the operation mode to the oil collection operation mode. In processes of subsequent steps S107 to S110, controller 101 controls the oil returning amount regulating valve (valve 13), the oil storage amount regulating valve (valve 11), and the shutoff valve (valve 12) to adjust the liquid level height.

In step S107, controller 101 detects the liquid level height in oil reservoir 6 by liquid level sensor 52. Then, in step S108, the liquid level height is compared with a defined position. When the liquid level height is less than the defined position (YES in S108), in step S110, controller 101 controls the valves to attain a small degree of opening of the oil returning amount regulating valve (valve 13), a large degree of opening of the oil storage amount regulating valve (valve 11), and an open state of the shutoff valve (valve 12). On the other hand, when the liquid level height is more than or equal to the defined position (NO in S108), in step S109, controller 101 controls the valves to attain a small degree of opening of the oil returning amount regulating valve (valve 13), a small degree of opening of the oil storage amount regulating valve (valve 11), and an open state of the shutoff valve (valve 12).

When the respective degrees of opening of the three valves are determined in one of steps S103, S109, and S110, the control is returned to the main routine.

Although the flows of the refrigerant and refrigeration oil are basically the same as those in the first embodiment, the degrees of opening of the valves are controlled to maintain, around the defined position, the liquid level height of the mixed liquid in oil reservoir 6.

When the liquid level height of oil reservoir 6 is less than the defined position, the mixed liquid having flown from oil separator 2 flows into oil reservoir 6 through the oil storage amount regulating valve (valve 11). The gas refrigerant in oil reservoir 6 flows into low-pressure pipe 35 via gas removing pipe 22. The mixed liquid having flown into oil reservoir 6 is retained in oil reservoir 6 to raise the liquid level height. When the liquid level height is more than or equal to the defined position, the degrees of opening of the oil storage amount regulating valve (valve 11) and the oil returning amount regulating valve (valve 13) are controlled to balance respective amounts of the mixed liquid passing through the valves, thereby maintaining the liquid level height.

As described above, according to the refrigeration cycle apparatus of the second embodiment, an appropriate amount of surplus oil can be stored by adjusting the liquid level height of the mixed liquid in oil reservoir 6, whereby reliability of compressor 1 and performance of the refrigerating cycle can be improved.

Third Embodiment

In a third embodiment, an oil concentration is managed instead of the liquid level height in oil reservoir 6.

Figure 6:
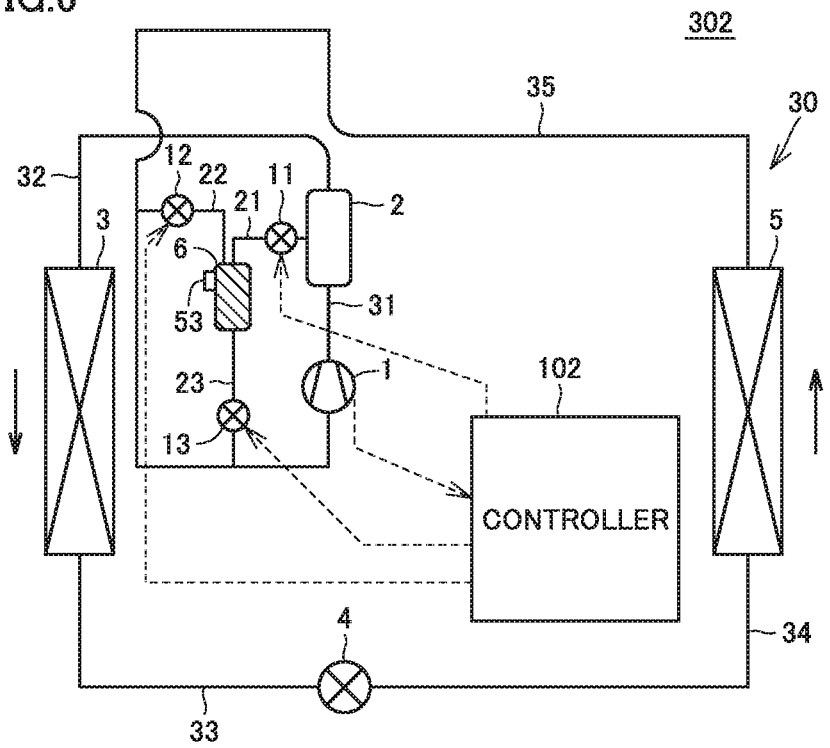
FIG. 6 shows a configuration of a refrigeration cycle apparatus according to a third embodiment.

FIG. 6 shows a configuration of a refrigeration cycle apparatus according to the third embodiment. A refrigeration cycle apparatus 302 shown in FIG. 6 includes: a refrigerant circuit 30 in which refrigerant circulates in the order of a compressor 1, an oil separator 2, a first heat exchanger 3, a decompressing apparatus 4, and a second heat exchanger 5 and returns to compressor 1; an oil reservoir 6; pipes 21 to 23; and valves 11 to 13. These are the same as those of refrigeration cycle apparatus 300 of each of the first and second embodiments, and will not be repeatedly described.

Refrigeration cycle apparatus 302 further includes: an oil concentration sensor 53 configured to detect an oil concentration of liquid stored in oil reservoir 6; and a controller 102 configured to control valves 11 to 13 in accordance with an output of oil concentration sensor 53. Controller 102 controls valves 11 to 13 to allow the oil concentration in the mixed liquid in oil reservoir 6 to coincide with a defined concentration.

Although oil concentration sensor 53 is configured to detect the concentration of the refrigeration oil in the mixed liquid of the refrigeration oil and the liquid refrigerant, oil concentration sensor 51 may be configured to detect a concentration of refrigerant in the mixed liquid. As oil concentration sensor 53, sensors for detecting concentrations in accordance with various methods can be used, such as a capacitance sensor, a sonic sensor, and an optical sensor, for example.

Figure 7:
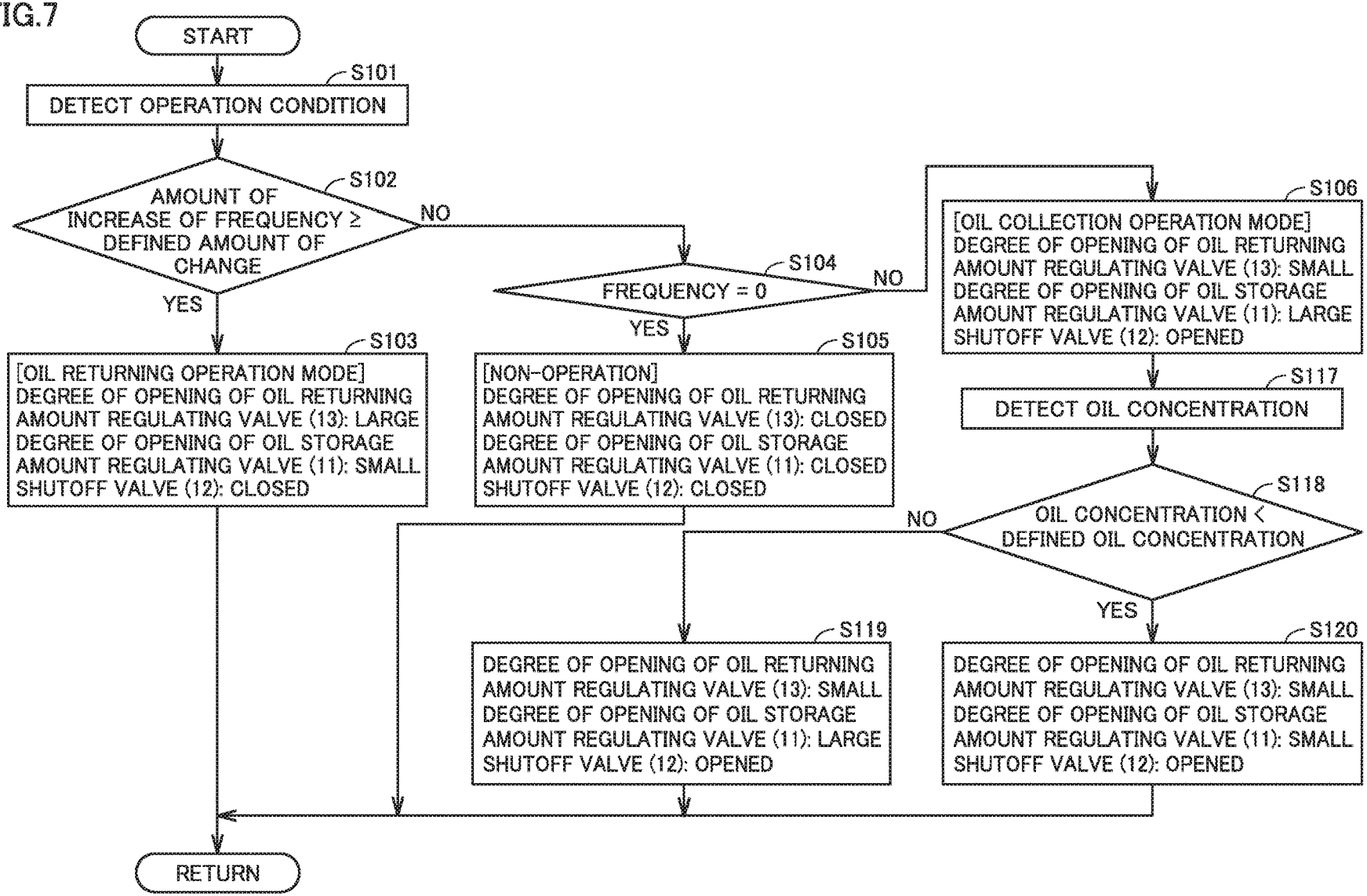
FIG. 7 is a flowchart for illustrating control performed by a controller 102 for valves.

FIG. 7 is a flowchart for illustrating control performed by controller 102 for the valves. A process of this flowchart is invoked from a main routine for performing general control for refrigeration cycle apparatus 302 and is executed, whenever a certain period of time elapses or a starting condition is satisfied.

With reference to FIG. 6 and FIG. 7, controller 102 first detects an operation condition of refrigeration cycle apparatus 300 in a step S101. This operation condition also includes an operation frequency of compressor 1.

Then, in a step S102, controller 102 compares an amount of increase of the operation frequency of compressor 1 with a defined amount of change. When the operation frequency of compressor 1 is increased by more than or equal to the defined amount of change (YES in S102), a large amount of refrigeration oil is required in compressor 1. Hence, in a step S103, controller 102 sets the operation mode to an oil returning operation mode.

In the oil returning operation mode, controller 102 controls the degree of opening of the oil returning amount regulating valve (valve 13) to attain a large degree of opening or a fully opened state, controls the degree of opening of the oil storage amount regulating valve (valve 11) to attain a small degree of opening or a fully closed state, and controls the shutoff valve (valve 12) to attain a fully closed state.

On the other hand, when the amount of increase of the operation frequency of compressor 1 is less than the defined amount of change (NO in S102), controller 102 detects the frequency of compressor 1 in a step S104.

When the operation frequency of compressor 1 is zero (YES in S104), during a non-operational period of refrigeration cycle apparatus 300 (compressor 1), controller 102 controls to fully close the oil returning amount regulating valve (valve 13), the oil storage amount regulating valve (valve 11), and the shutoff valve (valve 12) in step S105. By closing the valves while compressor 1 is non-operational, a flow path between oil reservoir 6 and refrigerant circuit 30 is shut off, whereby the refrigerant in refrigerant circuit 30 is not moved to oil reservoir 6. In this way, even when the temperature of the mixed liquid in oil reservoir 6 is decreased during the non-operational period of compressor 1, the refrigerant is prevented from being moved from refrigerant circuit 30 and being dissolved in the mixed liquid. Accordingly, the oil concentration of the mixed liquid is prevented from being decreased.

On the other hand, when the frequency is not zero and the amount of increase of the operation frequency of compressor 1 is less than the defined amount of change (NO in S104), the amount of required refrigeration oil in compressor 1 is a normal amount thereof. Hence, in a step S106, controller 102 sets the operation mode to the oil collection operation mode to decrease the degree of opening of the oil returning amount regulating valve (valve 13).

In the oil collection operation mode, controller 102 controls the degree of opening of the oil returning amount regulating valve (valve 13) to attain a small degree of opening or a fully closed state, controls the degree of opening of the oil storage amount regulating valve (valve 11) to attain a large degree of opening or a fully opened state, and controls the shutoff valve (valve 12) to attain a fully opened state.

Then, in a step S117, controller 102 detects the oil concentration of the mixed liquid in oil reservoir 6 using oil concentration sensor 53. In a step S118, controller 102 compares the detected oil concentration with the defined oil concentration.

When the oil concentration is less than the defined oil concentration (YES in S118), in a step S120, controller 102 controls to attain a small degree of opening of the oil returning amount regulating valve (valve 13), a large degree of opening of the oil storage amount regulating valve (valve 11), and a fully opened state of the shutoff valve (valve 12).

On the other hand, when the oil concentration is more than or equal to the defined oil concentration (NO in S118), in a step S119, controller 102 controls to attain a small degree of opening of the oil returning amount regulating valve (valve 13) and a small degree of opening of the oil storage amount regulating valve (valve 11), and closes the shutoff valve (valve 12).

When the respective degrees of opening of the three valves are determined in one of steps S103, S119, and S120, the control is returned to the main routine.

Although the flows of the refrigerant and refrigeration oil are basically the same as those in the first and second embodiments, the degrees of opening of the valves are controlled to maintain, around the defined oil concentration, the oil concentration of the mixed liquid in oil reservoir 6.

Figure 8:
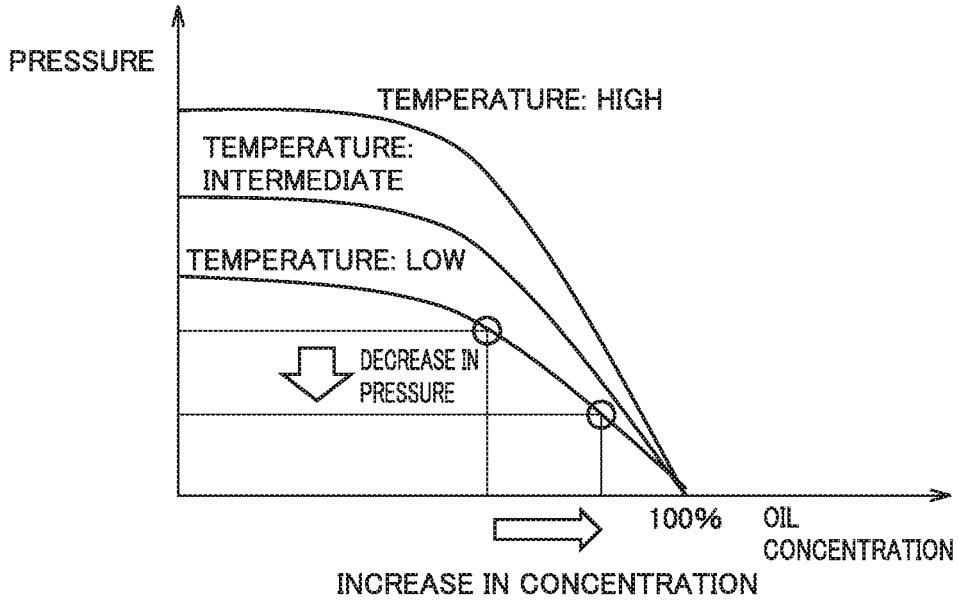
FIG. 8 shows a relation among a pressure, an oil concentration, and a temperature in oil reservoir 6.

FIG. 8 shows a relation among pressure, oil concentration, and temperature in oil reservoir 6.

When the oil concentration is less than the defined oil concentration, controller 102 attains a small degree of opening of the oil storage amount regulating valve (valve 11) to decrease pressure in oil reservoir 6 and increase the oil concentration as shown in FIG. 8.

Conversely, when the oil concentration is more than or equal to the defined oil concentration, controller 102 attains a large degree of opening of the oil storage amount regulating valve (valve 11) to increase the pressure in oil reservoir 6 and decrease the oil concentration.

According to the refrigeration cycle apparatus of the third embodiment, the oil concentration can be changed by adjusting the pressure in the oil reservoir during the operation. Accordingly, a required oil concentration is secured in compressor 1, whereby reliability of compressor 1 can be improved.

In addition, by controlling the oil concentration of the mixed liquid, the amount of refrigerant sealed in the refrigerant circuit can be reduced, or performance of the refrigeration cycle can be improved by optimizing the amount of refrigerant in the refrigerant circuit.

Figure 9:
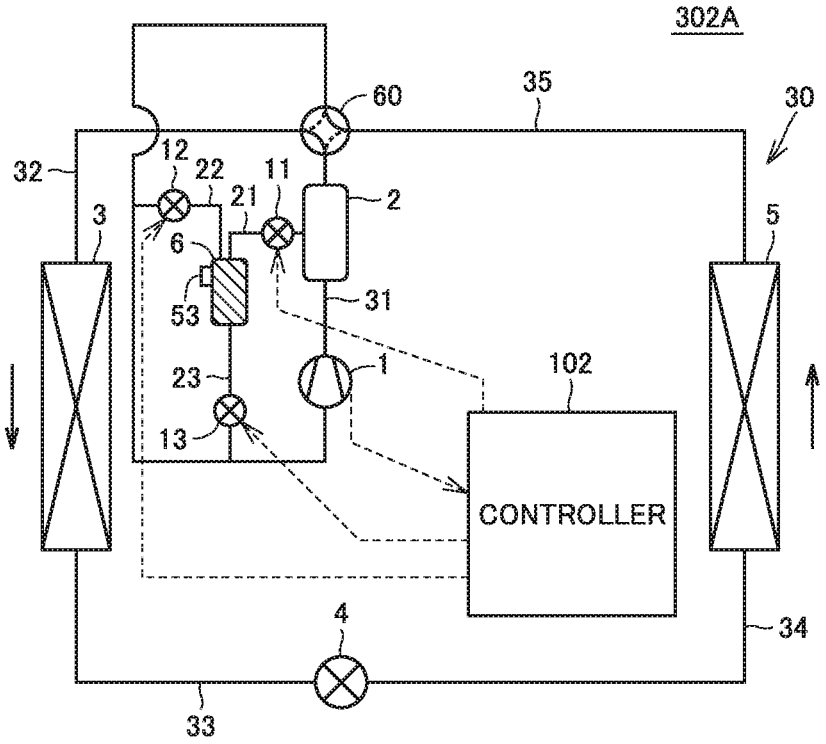
FIG. 9 shows a configuration of a refrigeration cycle apparatus according to a modification of the third embodiment.

FIG. 9 shows a configuration of a refrigeration cycle apparatus according to a modification of the third embodiment. A refrigeration cycle apparatus 302A shown in FIG. 9 is obtained by adding a four-way valve 60 to refrigeration cycle apparatus 302 shown in FIG. 6.

In refrigeration cycle apparatus 302A according to the modification of the third embodiment, a defined oil concentration is changed in accordance with an operation state of the refrigeration cycle apparatus.

Figure 10:
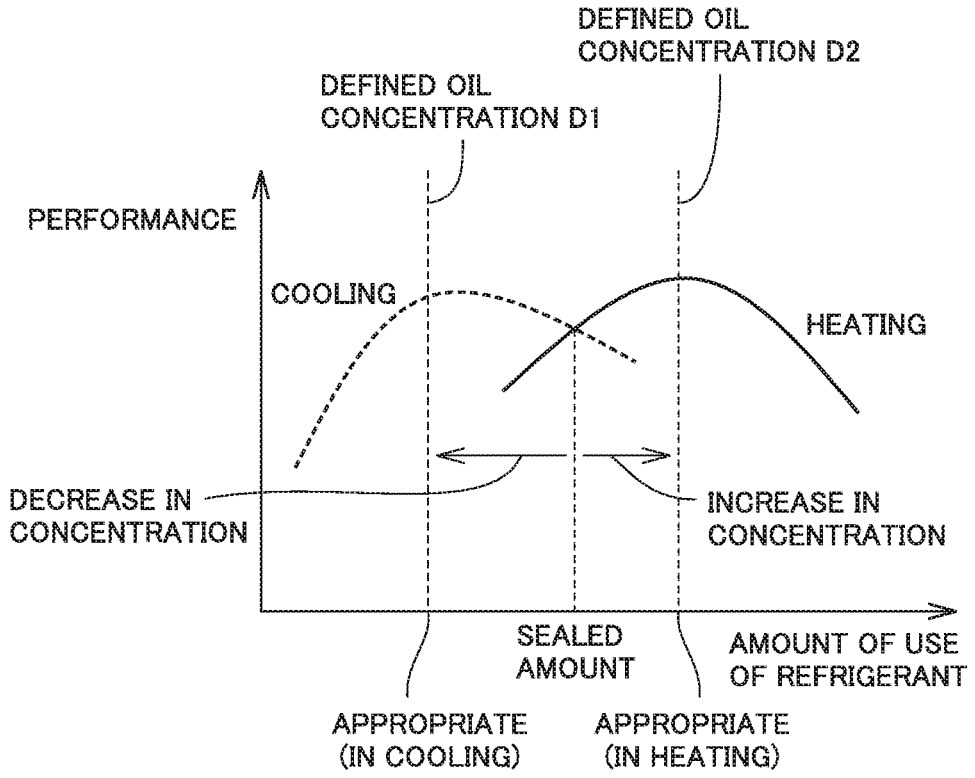
FIG. 10 shows that an appropriate amount of use of refrigerant differs between cooling and heating.

FIG. 10 shows that an appropriate amount of use of refrigerant differs between cooling and heating. In this case, an optimum value of the oil concentration in oil reservoir 6 also differs between the cooling and the heating. In the refrigeration cycle apparatus switchable between the cooling and the heating, an amount of refrigerant sealed in the refrigeration circuit is frequently set to an intermediate point between the appropriate amount in the cooling and the appropriate amount in the heating as shown in FIG. 10.

That is, the amount of refrigerant sealed therein in FIG. 10 is a defined amount of refrigerant sealed in the outdoor unit at the time of shipping. The appropriate amount of use of refrigerant in the heating is more than the amount of refrigerant sealed therein, whereas the appropriate amount of use of refrigerant in the cooling is less than the amount of refrigerant sealed therein. On this occasion, by monitoring the concentration using oil concentration sensor 53 to adjust the pressure of oil reservoir 6, the amount of use of refrigerant can be adjusted to each of the appropriate amount in the cooling and the appropriate amount in the heating.

Therefore, when refrigeration cycle apparatus 302A is operated to switch between the cooling and the heating, the defined oil concentration in step S118 of FIG. 7 is switched between that in the cooling operation and that in the heating operation.

The defined oil concentration is set to satisfy a defined oil concentration D1<a defined oil concentration D2, where defined oil concentration D1 represents a defined oil concentration when performing an operation in which an internal volume of the high-pressure side heat exchanger<an internal volume of the low-pressure side heat exchanger is satisfied, and defined oil concentration D2 represents a defined oil concentration when performing an operation in which the internal volume of the high-pressure side heat exchanger>the internal volume of the low-pressure side heat exchanger is satisfied.

As described above, according to the refrigeration cycle apparatus of each of the third embodiment and the modification, the following effects are obtained.

Since the oil concentration is detected instead of estimating the oil concentration from the temperature, reliability of the compressor can be improved.

An appropriate amount of refrigerant differs depending on an operation state. By changing the defined oil concentration depending on the operation state, the amount of refrigerant dissolved in the mixed liquid is adjusted and the refrigerant is discharged into the refrigerant circuit, whereby performance can be improved depending on the operation state.

Since the oil concentration can be managed at the appropriate value with respect to the amount of refrigerant sealed therein, an extra amount of refrigerant corresponding to an amount of refrigerant to be dissolved into the oil does not need to be sealed, whereby the amount of refrigerant can be reduced.

The embodiments disclosed herein are illustrative and non-restrictive in any respect. The scope of the present invention is defined by the terms of the claims, rather than the embodiments described above, and is intended to include any modifications within the scope and meaning equivalent to the terms of the claims.

The invention claimed is:

1. A refrigeration cycle apparatus comprising:

a refrigerant circuit in which refrigerant circulates in the order of a compressor, an oil separator, a first heat exchanger, a decompressing apparatus, and a second heat exchanger and returns to the compressor;

an oil reservoir configured to store refrigeration oil;

a first pipe that connects the oil separator and the oil reservoir, the first pipe being configured to send the refrigeration oil separated by the oil separator to the oil reservoir;

a first valve provided at the first pipe;

a second pipe that connects the oil reservoir and a suction side of the compressor;

a second valve provided at the second pipe;

a third pipe that connects the oil reservoir and the suction side of the compressor at a position lower than a position at which the second pipe is connected to the oil reservoir; and a third valve provided at the third pipe, wherein the first to third valves are closed in a non-operational period of the compressor;

the refrigeration cycle apparatus further comprising:

an oil concentration sensor configured to detect an oil concentration of liquid stored in the oil reservoir; and a controller configured to control respective degrees of opening of the first to third valves to allow the oil concentration detected by the oil concentration sensor to coincide with a defined concentration, wherein when the oil concentration detected by the oil concentration sensor is lower than the defined concentration, the controller is configured to decrease the degree of opening of the first valve to be less than the degree of opening of the first valve when the oil concentration is higher than the defined concentration.

* * * * *